US009276318B2

(12) United States Patent
Shimasaki

(10) Patent No.: US 9,276,318 B2
(45) Date of Patent: Mar. 1, 2016

(54) COUPLER APPARATUS AND COMMUNICATION APPARATUS

(75) Inventor: Hiroshi Shimasaki, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 539 days.

(21) Appl. No.: 13/550,827

(22) Filed: Jul. 17, 2012

(65) Prior Publication Data

US 2013/0113675 A1 May 9, 2013

(30) Foreign Application Priority Data

Nov. 4, 2011 (JP) ..... 2011-242555

(51) Int. Cl.
*H01Q 1/48* (2006.01)
*H01Q 9/04* (2006.01)
*H01Q 1/22* (2006.01)

(52) U.S. Cl.
CPC ..... *H01Q 9/0407* (2013.01); *H01Q 1/2266* (2013.01)

(58) Field of Classification Search
CPC ..... H01Q 1/2266; H01Q 9/0407
USPC ..... 343/848, 845, 846; 455/562.1, 575.7, 455/121, 129, 63.4, 13.3, 19, 83, 575.1
See application file for complete search history.

(56) References Cited

U.S. PATENT DOCUMENTS 5,184,143 A * 2/1993 Marko ..... 343/749
6,662,028 B1 * 12/2003 Hayes et al. ..... 455/575.7
7,649,499 B2 1/2010 Watanabe
8,248,308 B2 8/2012 Shimasaki
2002/0109634 A1 * 8/2002 Aisenbrey ..... 343/700 MS
2011/0128189 A1 6/2011 Shimasaki
2011/0156980 A1 * 6/2011 Shimasaki et al. ..... 343/848

FOREIGN PATENT DOCUMENTS

| | | |
|---|---|---|
| JP | 05-183311 | 7/1993 |
| JP | 2002-141723 | 5/2002 |
| JP | 2011-114705 | 6/2011 |
| JP | 2011-151763 | 8/2011 |
| JP | 2011-166601 | 8/2011 |
| WO | WO 2007/049376 | 5/2007 |

OTHER PUBLICATIONS

First Office Action for corresponding Japanese Application No. 2011-242555, mailed Nov. 20, 2012, 7 pages including translation.

* cited by examiner

*Primary Examiner* — Sue A Purvis
*Assistant Examiner* — Jae Kim
(74) *Attorney, Agent, or Firm* — Knobbe, Martens, Olson & Bear LLP

(57) ABSTRACT

According to one embodiment, a coupler apparatus includes a coupling element, a ground plane, and at least one connecting element. The coupling element which is made of a tabular electrical conducting material and in which power feeding is performed to a reference point. The ground plane which is made of a tabular electrical conducting material and partially faces a part of the coupling element. The connecting element which is made of an electrical conducting material, disposed to the ground plane, contact to a metal member provided to a communication apparatus to face the ground plane, and electrically connects the ground plane to the metal member.

14 Claims, 10 Drawing Sheets

COUPLER APPARATUS AND COMMUNICATION APPARATUS

CROSS-REFERENCE TO RELATED APPLICATIONS

This application is based upon and claims the benefit of priority from prior Japanese Patent Application No. 2011-242555, filed Nov. 4, 2011, the entire contents of which are incorporated herein by reference.

FIELD

Embodiments described herein relate generally to a coupler apparatus and communication apparatus.

BACKGROUND

A coupler apparatus having a configuration in which a coupling element and a ground plane both having a tabular shape are arranged to face each other is known from Jpn. Pat. Appln. KOKAI Publication No. 2011-151763, Jpn. Pat. Appln. KOKAI Publication No. Hei 5-183311, and Jpn. Pat. Appln KOKAI Publication No. 2011-114705.

It is often the case that, when the coupler apparatus having the above-described configuration is mounted on a communication apparatus, a metal (which will be referred to as a neighboring metal hereinafter) such as a metal surface of a housing of the communication apparatus or a metal housing of another device mounted on the communication apparatus faces the ground plane.

Further, when the neighboring metal faces the ground plane in this manner, a current is induced in the neighboring metal with an operation of the coupler apparatus, and coupling characteristics may be deteriorated.

Under the circumstances, it has been desired to suppress a deterioration in coupling characteristics of the coupler apparatus even though the apparatus is used in a situation that the neighboring metal faces the ground plane.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIG. 2 is mounted;

DETAILED DESCRIPTION

Various embodiments will be described hereinafter with reference to the accompanying drawings.

In general, according to one embodiment, a coupler apparatus mounted on a communication apparatus that transmits electromagnetic waves to or receives electromagnetic waves from another coupler apparatus by electromagnetic coupling, includes a coupling element, a ground plane, and at least one connecting element. The coupling element made of a first tabular electrical conducting material, wherein power feeding is performed to a reference point. The ground plane made of a second tabular electrical conducting material and partially facing a part of the coupling element. The connecting element made of an electrical conducting material, disposed to the ground plane, contacting a metal member provided to the communication apparatus to face the ground plane, and electrically connecting the ground plane to the metal member.

Figure 1:
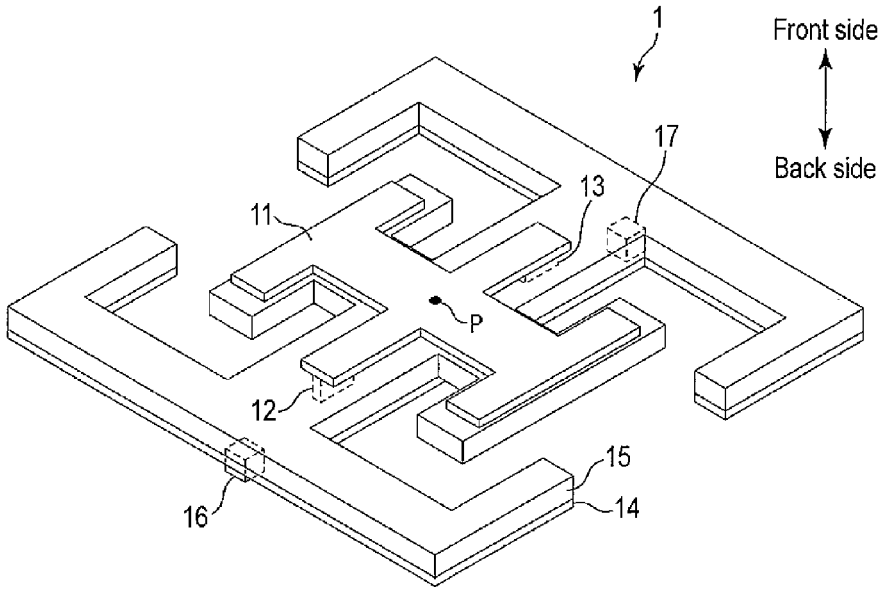
FIG. 1 is a perspective view of a coupler apparatus according to an embodiment.
Figure 2:
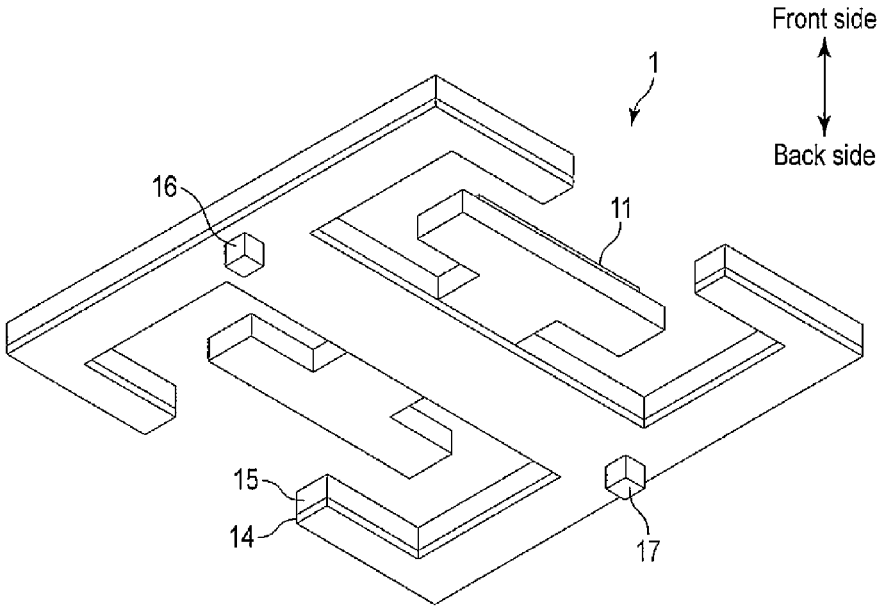
FIG. 2 is a perspective view of the coupler apparatus according to an embodiment.
Figure 3:
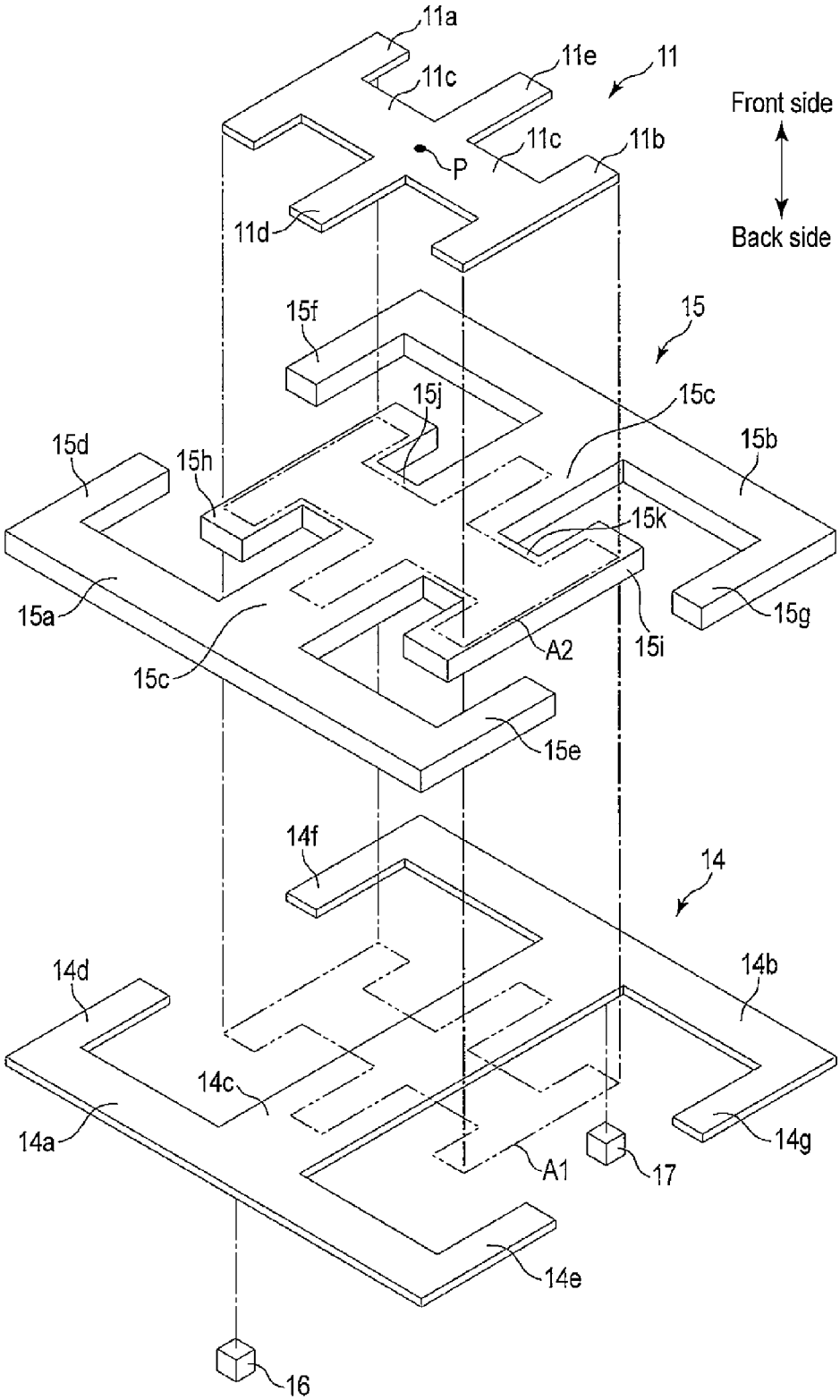
FIG. 3 is an exploded perspective view of the coupler apparatus depicted in FIG. 1 and FIG. 2.

FIG. 1 and FIG. 2 are perspective views of a coupler apparatus 1 according to this embodiment. FIG. 3 is an exploded perspective view of the coupler apparatus 1.

As shown in FIG. 1 to FIG. 3, the coupler apparatus 1 includes a coupling element 11, short elements 12 and 13, a ground plane 14, a dielectric 15, and connecting elements 16 and 17.

The coupling element 11, the ground plane 14, and the dielectric 15 all have a tabular shape, and the coupling element 11, the dielectric 15, and the ground plane 14 are aligned in the mentioned order along their thickness directions in a state that their thickness directions are conformed to each other. It is to be noted that the alignment direction (a thickness direction/height direction) of the coupling element 11, the dielectric 15, and the ground plane 14 is determined as a front-and-back direction of the coupler apparatus 1 and the side of the coupling element 11 is determined as a front side in the following description. That is, the coupling element 11 faces the dielectric 15 on the front side of the coupler apparatus 1, and the ground plane 14 faces the dielectric 15 on the back side of the coupler apparatus 1.

The coupling element 11 is obtained by forming an electrical conducting material into such a shape as depicted in FIG. 3. That is, the coupling element 11 has the following shape on a plane orthogonal to its thickness direction.

The coupling element 11 includes rectangular portions 11*a*, 11*b*, 11*c*, 11*d*, and 11*e*. The rectangular portions 11*a* and 11*b* are apart from and substantially parallel to each other. The rectangular portion 11*c* extends along an alignment direction of the rectangular portions 11*a* and 11*b*, and its both ends are in contact with intermediate parts of the rectangular portions 11*a* and 11*b*. The rectangular portions 11*d* and 11*e* protrude from the center of the rectangular portion 11*c* in opposite directions. The rectangular portions 11*a*, 11*b*, and 11*c* all have widths that enable high-frequency signals transmitted/received with respect to the other coupler apparatus to flow through the substantially entire region.

The short elements 12 and 13 have a rectangular tabular shape, and their thickness direction is orthogonal to the thickness direction of the coupling element 11. The short element 12 is in contact with the rectangular portion 11*d* at an end of the rectangular portion 11*d*. The short element 13 is in contact with the rectangular portion 11*e* at an end of the rectangular portion 11*e*. However, contact positions of the short elements 12 and 13 with respect to the coupling element 11 may be any positions other than ends of the rectangular portions 11*d* and 11*e*. That is, the short element 12 is in contact with the rectangular portion 11*d* in the range from a feeding point P to the end of the rectangular portion 11*d*, and the short element 13 is in contact with the rectangular portion 11*e* in the range from the feeding point P the end of the rectangular portion 11*e*. The short elements 12 and 13 may be integral with the coupling element 11, or separate bodies may be disposed by, e.g., soldering or a conductive adhesive. The short elements 12 and 13 are arranged to penetrate through the dielectric 15. The short elements 12 and 13 are electrically connected to the ground plane 14 by, e.g., soldering or a conductive adhesive. It is to be noted that the short elements 12 and 13 and openings of the dielectric 15 from which the short element 12 and 13 penetrate are omitted in FIG. 3. Therefore, the short elements 12 and 13 short the coupling element 11 and the ground plane 14 at different positions, respectively.

The ground plane 14 is obtained by forming a thin layer made of an electrical conducting material on a substantially entire surface of the dielectric 15. The ground plane 14 is apart from the coupling element 11 in such a manner that direct electrical conduction (which is different from electrical conduction between the ground plane 14 and the coupling element 11 through the short element 12) is not achieved between the ground plane 14 and the coupling element 11. In the ground plane 14, a the thin layer made of the electrical conducting material is formed into such a shape as depicted in FIG. 3. That is, the ground plane 14 has the following shape on a plane orthogonal to its thickness direction.

The ground plane 14 has seven rectangular shapes 14*a*, 14*b*, 14*c*, 14*d*, 14*e*, 14*f*, and 14*g*. The rectangular portions 14*a* and 14*b* are apart from and parallel to each other. The rectangular portion 14*c* extends along an alignment direction of the rectangular portions 14*a* and 14*b*, and its both ends are in contact with intermediate parts of the rectangular portions 14*a* and 14*b*. The rectangular portions 14*d* and 14*e* extend from both ends of the rectangular portion 14*a* to the rectangular portion 14*b*. The rectangular portions 14*f* and 14*g* extend from both ends of the rectangular portion 14*b* to the rectangular portion 14*a*. A protruding length of each of the rectangular portions 14*d* and 14*e* from the rectangular portion 14*a* and a protruding length of each of the rectangular portions 14*f* and 14*g* from the rectangular portion 14*b* are set to prevent the rectangular portions 14*d* and the rectangular portion 14*f* from coming into contact with the rectangular portion 14*e* and the rectangular portion 14*g*. It is desirable for the protruding length of each of the rectangular portions 14*d* and 14*e* from the rectangular portion 14*a* to be not greater than a minimum clearance width between each of the rectangular portions 11*a* and 11*b* and the rectangular portion 14*a* in the horizontal direction and for the protruding length of each of the rectangular portions 14*f* and 14*g* from the rectangular portion 14*b* to be not greater than a minimum clearance width between each of the rectangular portions 11*a* and 11*b* and the rectangular portion 14*b* in the horizontal direction, but the present invention is not restricted thereto.

The dielectric 15 is obtained by forming an dielectric material into a tabular shape. The dielectric 15 is arranged in a gap between the coupling element 11 and the ground plane 14. In the coupler apparatus 1, the dielectric 15 has a thickness substantially equal to an gap between the coupling element 11 and the ground plane 14 and fills the gap between the coupling element 11 and the ground plane 14. Therefore, a greater part of the short element 12 is placed in the dielectric 15. However, the thickness of the dielectric 15 may be smaller than the gap between the coupling element 11 and the ground plane 14. When the thickness of the dielectric 15 is smaller than the gap between the coupling element 11 and the ground plane 14, the dielectric 15 is arranged to be in contact with the ground plane 14 and to be apart from the coupling element 11 as a typical pattern. However, the dielectric 15 may be arranged to be in contact with the coupling element 11 and to be apart from the ground plane 14. Alternatively, the dielectric 15 may be arranged to be apart from both the coupling element 11 and the ground plane 14. Furthermore, a first dielectric which is in contact with the coupling element 11 and a second dielectric which is in contact with the ground plane 14 may be provided, respectively, and these first and second dielectrics may be arranged to be apart from each other.

The dielectric 15 may have an arbitrary shape on a plane orthogonal to its thickness direction.

In the coupler apparatus 1 shown in FIG. 1 to FIG. 3, the dielectric 15 has a shape that covers the entire back-side surface of the coupling element 11 and the entire front-side surface of the ground plane 14, and it is arranged in such a state. Specifically, as shown in FIG. 3, the dielectric 15 includes rectangular portions 15*a*, 15*b*, 15*c*, 15*d*, 15*e*, 15*f*, 15*g*, 15*h*, 15*i*, 15*j*, and 15*k*. The rectangular portions 15*a* and 15*b* are apart from and parallel to each other. The rectangular portion 15*c* extends along an alignment direction of the rectangular portions 15*a* and 15*b*, and its both ends are in contact with intermediate parts of the rectangular portions 15*a* and 15*b*. The rectangular portions 15*d* and 15*e* extend from both ends of the rectangular portion 15*a* toward the rectangular portion 15*b*. The rectangular portions 15*f* and 15*g* extend from both ends of the rectangular portion 15*b* toward the rectangular portion 15*a*. A protruding length of each of the rectangular portions 15*d* and 15*e* from the rectangular portion 15*a* and a protruding length of each of the rectangular portions 15*f* and 15*g* from the rectangular portion 15*b* are set to prevent the rectangular portions 15*d* and the rectangular portion 15*f* from coming into contact with the rectangular portion 15*e* and the rectangular portion 15*g*. However, the rectangular portion 15*d* and the rectangular portion 15*f* may be bonded to substitute as one rectangular portion substantially parallel to the rectangular portion 15*c*. Moreover, the rectangular portion 15*e* and the rectangular portion 15*g* may be bonded to substitute as one rectangular portion substantially parallel to the rectangular portion 15*c*. The rectangular portions 15*h* and 15*i* are apart from and substantially parallel to each other. The rectangular portion 15*c* is placed between the rectangular portions 15*h* and 15*i*. Both ends of the rectangular portion 15*j* are in contact with an intermediate part of the rectangular portion 15*c* and an intermediate part of the rectangular portion 15*h*, respectively. Both ends of the rectangular portion 15*k* are in contact with the intermediate part of the rectangular portion 15*c* and an intermediate part of the rectangular portion 15*i*. Additionally, the rectangular portions 15*a*, 15*b*, 15*c*, 15*d*, 15*e*, 15*f*, and 15*g* face the rectangular portions 14*a*, 14*b*, 14*c*, 14*d*, 14*e*, 14*f*, and 14*g*, respectively, the rectangular portions 15*h* and 15*i* face the rectangular portions 11*a* and 11*b*, respectively, the rectangular portion 15*c* faces a part of the rectangular portion 11*c* and the rectangular portions 11*e* and 11*d*, and the rectangular portions 15*j* and 15*k* face a part of the rectangular portion 11*c*.

A region A1 indicated by an alternate long and short dash line in FIG. 3 represents a projection domain when the coupling element 11 is protected onto the front surface of the ground plane 14 in the front-and-back direction. A region A2 indicates a projection domain when the coupling element 11 is projected onto the front surface of the dielectric 15 in the front-and-back direction.

The connecting elements 16 and 17 are disposed on the back surface of the ground plane 14. Disposing positions of the connecting elements 16 and 17 on the ground plane 14 may be arbitrary, but the connecting element 16 is disposed to an intermediate part of the rectangular portion 14*a* and the connecting element 17 is disposed to an intermediate part of the rectangular portion 14*b* in the coupler apparatus 1 shown in FIG. 1 to FIG. 3. Therefore, the connecting elements 16 and 17 are aligned in substantially the same direction as the alignment direction of the short elements 12 and 13. The connecting elements 16 and 17 may be integral with the ground plane 14, or different bodies may be disposed by, e.g., solder or an electrical conductive adhesive.

The connecting elements 16 and 17 include an electrical conductive material. For example, as the connecting elements 16 and 17, a shield gasket or an electrically conductive contactor having a pin structure can be utilized. The shield gasket has a well-known structure in which an electrically conductive cloth or an electrically conductive mesh is wound around a core material having elasticity such as polyurethane. The electrically conductive contact having the pin structure has a well-known structure in which the pin can be stably brought into contact with a neighboring member by a spring or the like.

Figure 4:
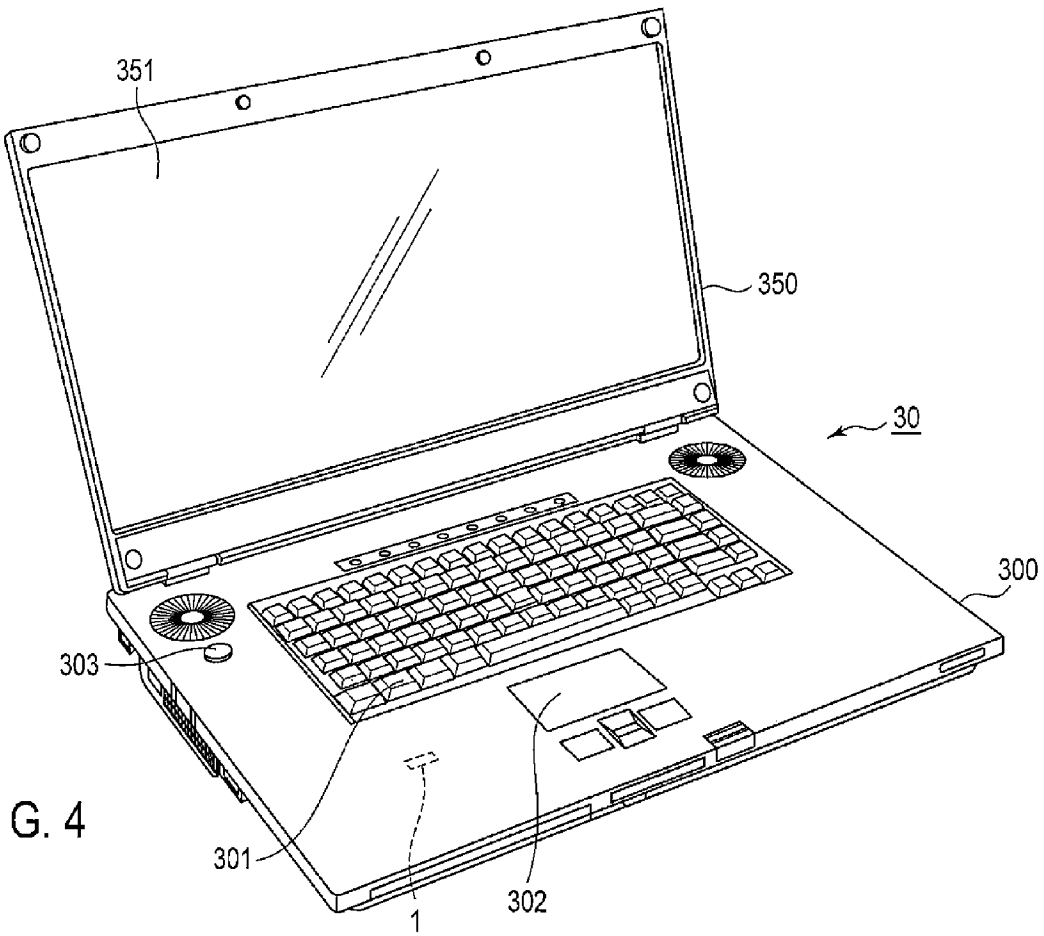
FIG. 4 is a perspective view showing appearance of an information processing apparatus as an example of a communication apparatus on which the coupler apparatus depicted in FIG. 1

FIG. 4 is a perspective view showing a communication appearance of an information processing apparatus 30 as an example of a device on which the coupler apparatus 1 is mounted. This information processing apparatus 30 is realized as, e.g., a notebook type portable personal computer that can be driven by a battery. The information processing apparatus 30 can be realized as a different type of apparatus such as a tablet personal computer or a mobile phone unit.

The information processing apparatus 30 includes a main body 300 and a display unit 350. The display unit 350 is supported by the main body 300 to allow its swiveling motion. The display unit 350 can form an opened state where an upper surface of the main body 300 is exposed and a closed state where the upper surface of the main body 300 is covered. In the display unit 350, a liquid crystal display (LCD) 351 is provided.

The main body 300 has a thin box-like housing. A keyboard 301, a touch pad 302, and a power switch 303 are arranged in the main body. Part of the keyboard 301, part of the touch pad 302, and part of the power switch 303 are exposed to the outside of the housing from an upper surface of the housing. Furthermore, in the main body 300, the coupler apparatus 1 is provided in the housing. A direction of the coupler apparatus 1 in the main body 300 may be arbitrary. However, the front-and-back direction in FIG. 1 is typically set to coincide with a direction orthogonal to the upper surface of the housing of the main body 300. Moreover, the coupling element 11 rather than the ground plane 14 is typically placed near the upper surface of the housing of the main body 300.

The coupler apparatus 1 is utilized to perform proximity wireless communication between the information processing apparatus 30 and the other non-illustrated apparatus. The proximity wireless communication is executed in a peer-to-peer system. A communication enabled range is, e.g., approximately 3 cm. Wireless connection between communication terminals is achieved when a distance between the coupler apparatuses 1 mounted in the respective communication terminals becomes equal to or below the communication enabled range. When the distance between the two coupler apparatuses 1 becomes equal to or below the communication enabled range, the wireless communication between the two communication terminals is achieved. Furthermore, data such as a data file specified by a user or a predetermined synchronization target data file is transmitted or received between the two communication terminals.

In the example depicted in FIG. 4, the coupler apparatus 1 is arranged below a region that functions as a palm rest on the upper surface of the main body 300. Therefore, a part of the palm rest functions as a communication surface. When the other communication terminal that is to perform the proximity wireless communication with the information processing apparatus 30 is moved closer to the palm rest, the wireless connection between this communication terminal and the information processing apparatus 30 can be achieved.

Figure 5:
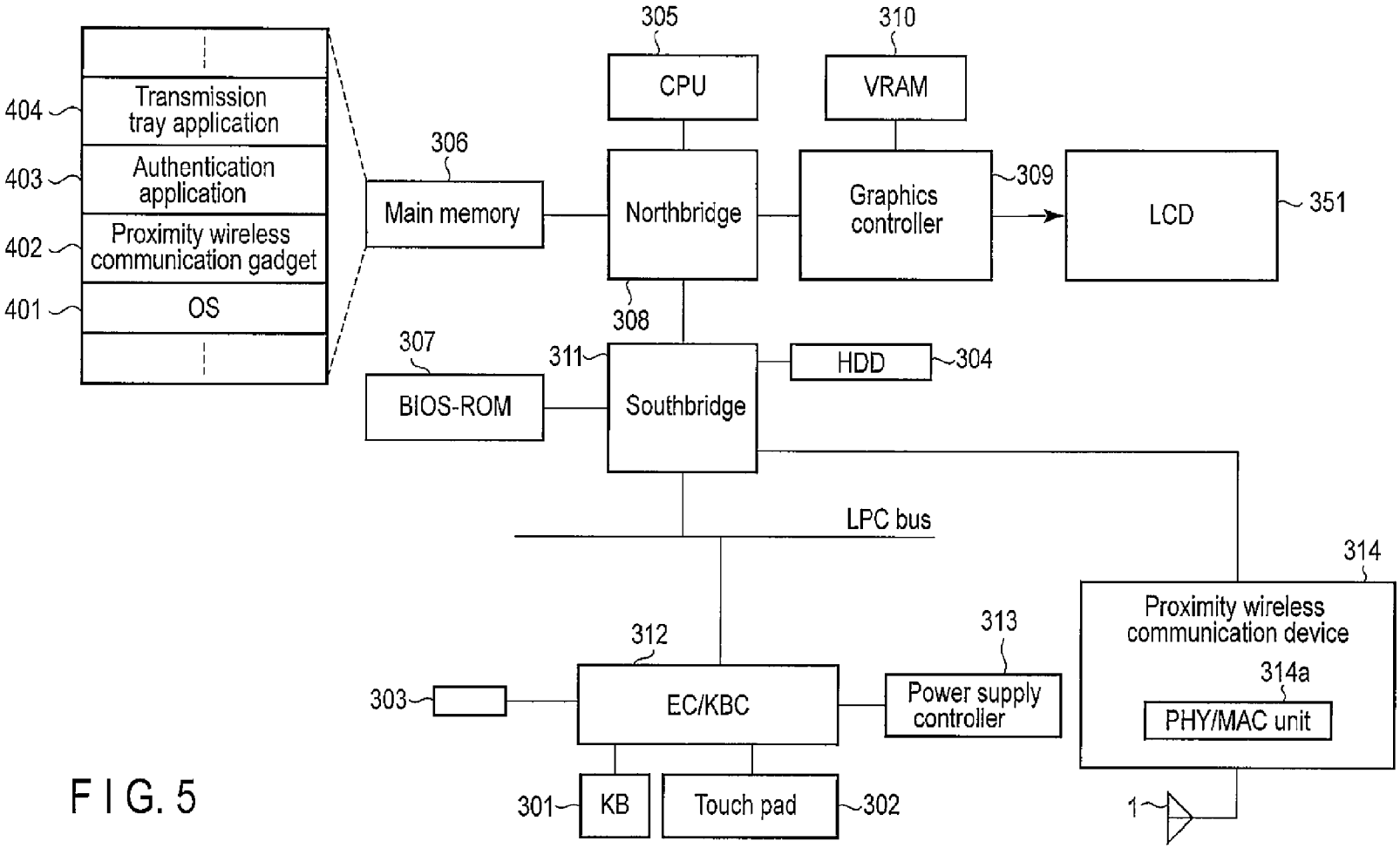
FIG. 5 is a block diagram of the information processing apparatus depicted in FIG. 4.

FIG. 5 is a block diagram of the information processing apparatus 30. It is to be noted that like reference numerals denote parts equal to those in FIG. 4.

The information processing apparatus 30 includes the coupler apparatus 1, the keyboard 301, the touch pad 302, the power switch 303, and the LCD 351, and this apparatus also includes a hard disk drive (HDD) 304, a CPU 305, a main memory 306, a basic input/output system-ROM (BIOS-ROM) 307, a northbridge 308, a graphics controller 309, a video memory (VRAM) 310, a southbridge 311, an embedded controller/keyboard controller IC (EC/KBC) 312, a power supply controller 313, and a proximity wireless communication device 314.

The hard disk drive 304 stores codes required to execute an operating system (OS) or various kinds of programs such as an BIOS update program.

The CPU 305 executes various kinds of programs loaded to the main memory 306 from the hard disk drive 304 in order to control operations of the information processing apparatus 30. Programs executed by the CPU 305 include an operating system 401, a proximity wireless communication gadget application program 402, an authentication application program 403, or a transmission tray application program 404.

Additionally, the CPU 305 executes a BIOS program stored in the BIOS-ROM 307 to control hardware.

The northbridge 308 connects a local bus of the CPU 305 and the southbridge 311. The northbridge 308 has a built-in memory controller that controls access of the main memory 306. Further, the northbridge 308 has a function of executing communication with the graphics controller 309 via an AGP bus and the like.

The graphics controller 309 controls the LCD 351. The graphics controller 309 generates a video signal representing a display image that is displayed in the LCD 351 from display data stored in the video memory 310. It is to be noted that the display data is written into the video memory 310 under control of the CPU 305.

The southbridge 311 controls devices on an LPC bus. The southbridge 311 has a built-in ATA controller configured to control the hard disk drive 304. Furthermore, the southbridge 311 has a function of controlling access of the BIOS-ROM 307.

The embedded controller/keyboard controller IC (EC/KBC) 312 is a one-chip microcomputer in which an embedded controller and a keyboard controller are integrated. The embedded controller controls a power supply controller to turn on/off the information processing apparatus 30 in accordance with operations of the power switch 303 by a user. The keyboard controller controls the keyboard 301 and the touch pad 302.

The power supply controller 313 controls operations of a non-illustrated power supply apparatus. It is to be noted that the power supply apparatus generates operation power for each unit in the information processing apparatus 30.

The proximity wireless communication device 314 includes a PHY/MAC unit 314*a*. The PHY/MAC unit 314*a* operates under control of the CPU 305. The PHY/MAC unit 314*a* communicates with the other communication terminal through the coupler apparatus 1. The proximity wireless communication device 314 is accommodated in a case of the main body 300.

It is to be noted that a peripheral component interconnect (PCI) bus is utilized for data transfer between the proximity wireless communication device 314 and the southbridge 311. It is to be noted that a PCI Express may be used in place of the PCI.

Figure 6:
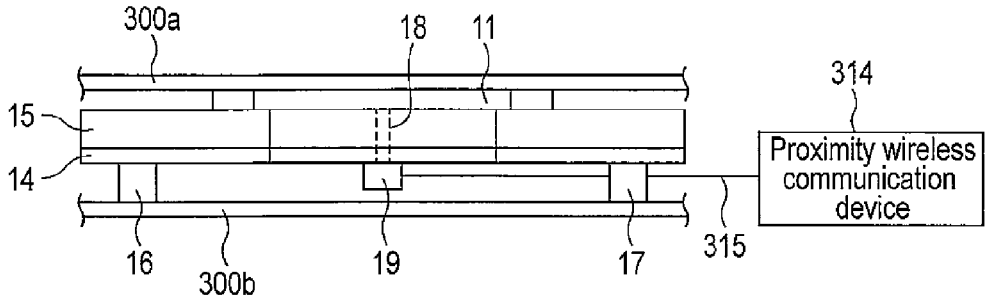
FIG. 6 is a view showing a disposed state of the coupler apparatus depicted in FIG. 1 and FIG. 2 in the information processing apparatus shown in FIG. 4.

FIG. 6 is a view showing a disposed state of the coupler apparatus 1 in the information processing apparatus 30.

The coupler apparatus 1 is bonded to a back side of a resin member 300*a* forming an upper surface (a region that functions as a palm rest) of the main body 300 in such a manner that its surface faces the coupling element 11. Further, the connecting elements 16 and 17 are arranged in the main body 300, contact to a metal member 300*b* facing the ground plane 14, and achieve electrical conduction between the ground plane 14 and the metal member 300*b*. It is to be noted that the metal member 300*b* is, e.g., a member used for forming an accommodation space for a hard disk drive.

It is to be noted that the coupler apparatus 1 further includes a feeder line 18 and a connector 19 as shown in FIG. 6. However, in FIG. 1 to FIG. 3, the feeder line 18 and the connector 19 are omitted.

The feeder line 18 is arranged to penetrate through the ground plane 14 and the dielectric 15. The feeder line 18 has one end connected to the coupling element 11 and the other end connected to the connector 19, respectively. A connecting position of the feeder line 18 in the coupling element 11 is a point P at the center of the rectangular portion 11*c*, and this point P serves as the feeding point.

The connector 19 is arranged to face the ground plane 14. This connector 19 electrically connects a cable 315 connected to the proximity wireless communication device 314 to the feeder line 18.

However, the feeding method and the mounting method are not restricted thereto.

An operation of the thus configured coupler apparatus 1 will now be described.

When a high-frequency signal is transmitted from the proximity wireless communication device 314, this high-frequency signal is supplied to the feeding point P of the coupling element 11 through the cable 315, the connector 19, and the feeder line 18. Then, a current associated with the high-frequency signal is generated in the coupling element 11. Current paths in the coupling element 11 are as indicated by heavy lines in FIG. 7.

That is, two current paths extending from the feeding point P to the rectangular portions 11*a* and 11*b* along the rectangular portion 11*c* are generated. In the rectangular portion 11*c*, a current is generated in its substantially entire region. Therefore, it can be considered that the current path in the rectangular portion 11*c* runs through the central of the rectangular portion 11*c*.

In each of the rectangular portions 11*a* and 11*b*, a current is generated in its substantially entire region. Therefore, it can be considered that the current paths in the rectangular portions 11*a* and 11*b* run through central parts of the rectangular portions 11*a* and 11*b*, respectively. Therefore, the current path is divided into two at the center of the rectangular portion 11*a* to reach ends E1 and E2 of the rectangular portion 11*a*. In the rectangular portion 11*b*, likewise, the current path is divided into two at the center of the rectangular portion 11*b* to reach ends E3 and E4 of the rectangular portion 11*b*.

In this manner, four current paths extending from the feeding point P to the ends E1, E2, E3, and E4 are formed. Therefore, the ends E1, E2, E3, and E4 function as open ends, respectively. Furthermore, a part of each of the four current paths is common to the other current paths. That is, the two current paths extending to the end E1 and the end E2, respectively are common to the current path extending to the rectangular portion 11*a* in the rectangular portion, and the two current paths extending to the end E3 and the end E4, respectively are common to the current path extending to the rectangular portion 11*b* in the rectangular portion.

Meanwhile, a size of the coupling element 11 is determined to meet the following conditions (1) to (3).

(1) A length of each of the four current paths corresponds to an integral multiple of ¼ of a wavelength λ of a center frequency of the high-frequency signal.

(2) A pair of the end E1 and the end E2 or a pair of the end E3 and the end E4 are provided at substantially symmetrical positions with a straight line L1 serving as an symmetry axis.

(3) The pair of the end E1 and the end E2 or the pair of the end E3 and the end E4 are provided at substantially symmetrical positions with a straight line L2 serving as an symmetry axis.

It is to be noted that the straight lines L1 and L2 are straight lines that run through the feeding point P and are orthogonal to each other.

However, the above-described conditions are just an example, and the coupling element 11 may be substituted by a coupling element having a different shape that do not meet a part of these conditions.

When these three conditions are met, each of the four current paths includes a portion facing two directions substantially orthogonal to each other. Moreover, when the four current paths extending from the feeding point P to the ends E1, E2, E3, and E4 are called first, second, third, and fourth current paths, respectively, the first current path and the third current path or the second current path and the fourth current path are substantially symmetrical with respect to the straight line L1. Additionally, the first current path and the second current path or the third current path and the fourth current path are substantially symmetrical with respect to the straight line L2.

Therefore, at least two of the four current paths include portions which are parallel to the same direction (which will be referred to as a first direction hereinafter) and opposite to each other. Further, at least two of the four current paths include portions which are parallel to a direction substantially orthogonal to the first direction (which will be referred to as a second direction hereinafter) and opposite to each other. It is to be noted that the first direction is parallel to the straight line L1 and the second direction is parallel to the straight line L2 in this embodiment, which is not indispensable.

Figure 7:
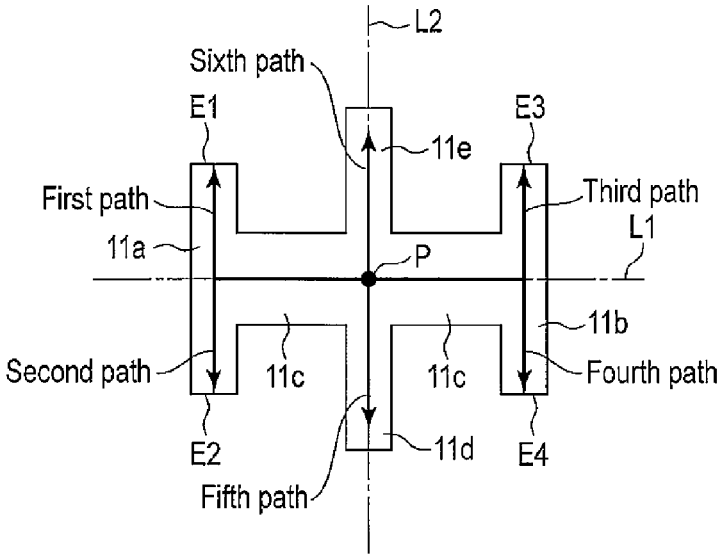
FIG. 7 is a view showing current paths in a coupling element depicted in FIG. 1 and FIG. 3.

It is to be noted that a current in a fifth path running through the rectangular portion 11*d* from the feeding point P toward the short element 16 and a current in a sixth path running through the rectangular portion 11*e* from the feeding point P to the short element 17 are also generated as shown in FIG. 7.

The currents generated in the coupling element 11 in the coupler apparatus 1 on the transmission side produce an electromagnetic wave around the coupler apparatus 1 on the transmission side. Further, this electromagnetic wave induces currents in the coupling element 11 in the coupler apparatus 1 on the reception side. In this manner, the two coupler apparatuses 1 transmit or receive the high-frequency signal to or from each other.

Figure 8:
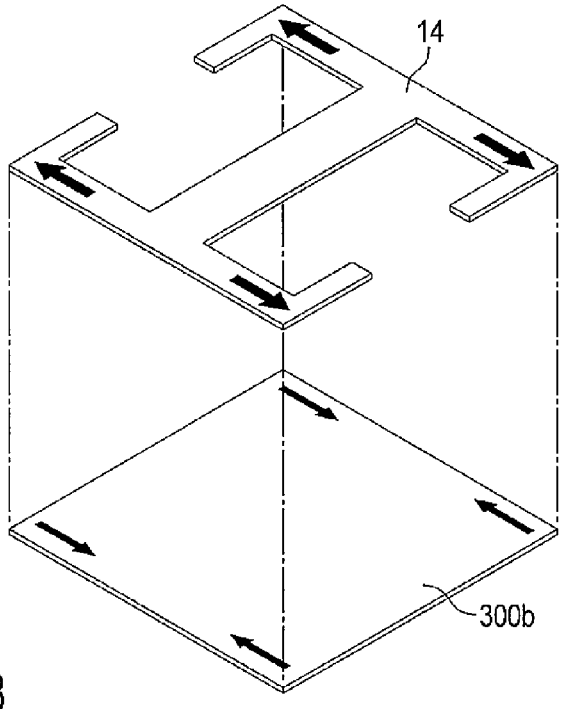
FIG. 8 is a view showing current distributions when power is fed to a feeding point in a comparative coupler apparatus.

FIG. 8 is a view showing current distributions when power is fed to the feeding point P in a comparative coupler apparatus.

Here, the comparative coupler apparatus is constituted by eliminating the connecting elements 16 and 17 from the coupler apparatus 1. Furthermore, FIG. 8 partially schematically shows a result of analyzing the current distributions of the ground plane 14 and the metal member 300*b*.

A direction of each arrow in FIG. 8 represents a direction of the current at a position where the arrow is shown, and a thickness of the same represents intensity of the current.

It can be understood from FIG. 8 that a current is inducted in a region of the metal member 300*b* facing the ground plane 14 with an operation of the comparative coupler apparatus. Furthermore, since this current is opposite to a current in an opposed region of the ground plane 14, a degree of coupling between the comparative coupler apparatus and another coupler apparatus is reduced.

Figure 9:
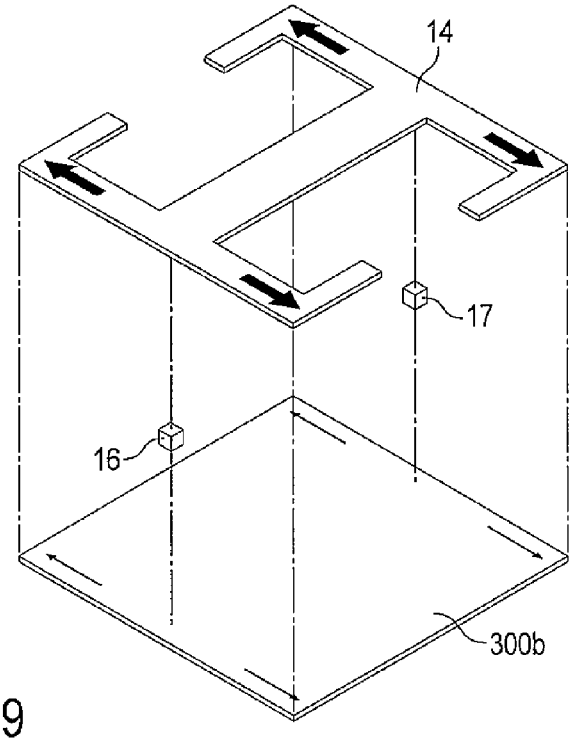
FIG. 9 is a view showing current distributions when power is fed to a feeding point by the coupler apparatus depicted in FIG. 1 to FIG. 3.

FIG. 9 is a view showing current distributions when power is fed to the feeding point P in the coupler apparatus 1.

FIG. 9 partially schematically shows a result of analyzing the current distributions of the ground plane 14 and the metal member 300*b*.

In case of the coupler apparatus 1, since the current excited in the ground plane 14 directly flows to the metal member 300*b* through the connecting elements 16 and 17, the current produced in the region of the metal member 300*b* facing the ground plane 14 has the same direction as the current in the opposed region of the ground plane 147. As a result, it is possible to suppress a reduction in degree of coupling between the coupler apparatus 1 and another coupler apparatus caused due to proximity of the metal member 300*b* to the coupler apparatus 1.

It is to be noted that currents in regions apart from the regions with the arrows in FIG. 8 and FIG. 9 in the metal member 300*b* are sufficiently smaller than the currents indicated by the arrows.

Figure 10:
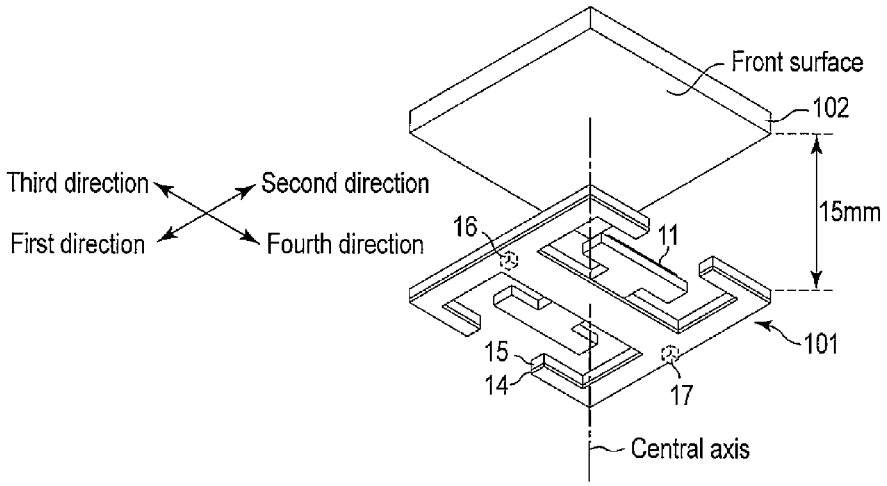
FIG. 10 is a view showing measurement conditions of an S parameter.
Figure 11:
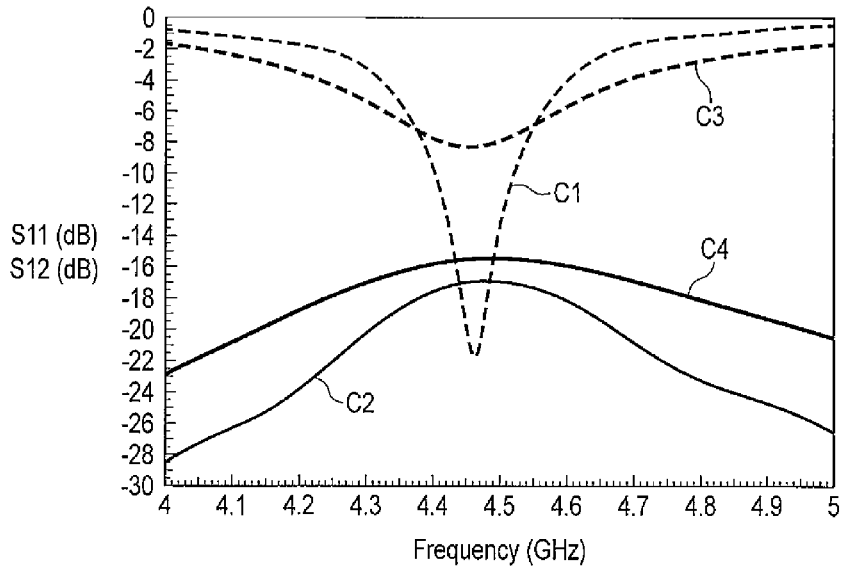
FIG. 11 is a view showing a relationship between a frequency and the S parameter (S11, S21) in each of the coupler apparatus depicted in FIG. 1 to FIG. 3 and the comparative coupler apparatus.

FIG. 11 shows a relationship between a frequency and an S parameter (S11, S21) under conditions that a test coupler 101 faces a reference coupler of TransferJet in a state depicted in FIG. 10. However, FIG. 10 roughly shows a positional relationship between the test coupler 101 and the reference coupler 102, and it does not correctly show a relationship between a clearance distance between the test coupler 101 and the reference coupler 102 and a size of the test coupler 101.

Although not shown in FIG. 10, a coupling element provided in the test coupler 101 is arranged to face a coupling element provided in the reference coupler 102. Further, the centers of both the coupling elements have a positional relationship depicted in FIG. 10.

In FIG. 11, curves C1 and C2 represent S11 and 21 between the test coupler 101 and the reference coupler 102 when the test coupler 101 is the comparative coupler apparatus, and curves C3 and C4 represent S11 and S21 between the test coupler 101 and the reference coupler 102 when the test coupler 101 is the coupler apparatus 1.

It is obvious from FIG. 11 that S21, i.e., a transmission coefficient can be improved at all frequencies in a required frequency band because of presence of the connecting elements 16 and 17. It is to be noted that a difference in S21 at the center frequency of the required frequency band is approximately 2.2 dB.

This embodiment can be modified in many ways as follows.

Figure 12:
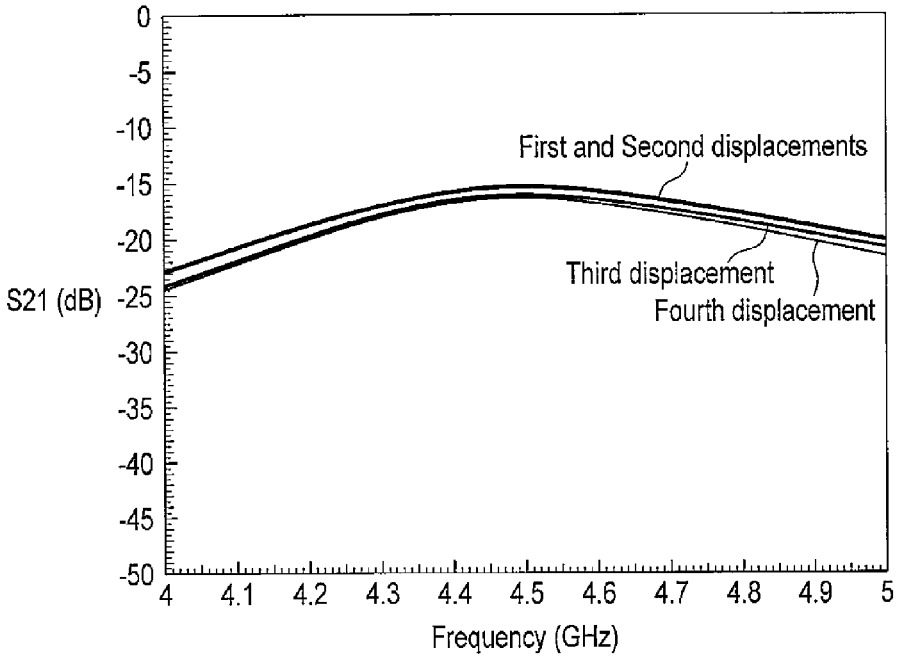
FIG. 12 is a view showing a change in S21 associated with a displacement of the coupler apparatus depicted in FIG. 1 to FIG. 3 from a reference coupler.
Figure 13:
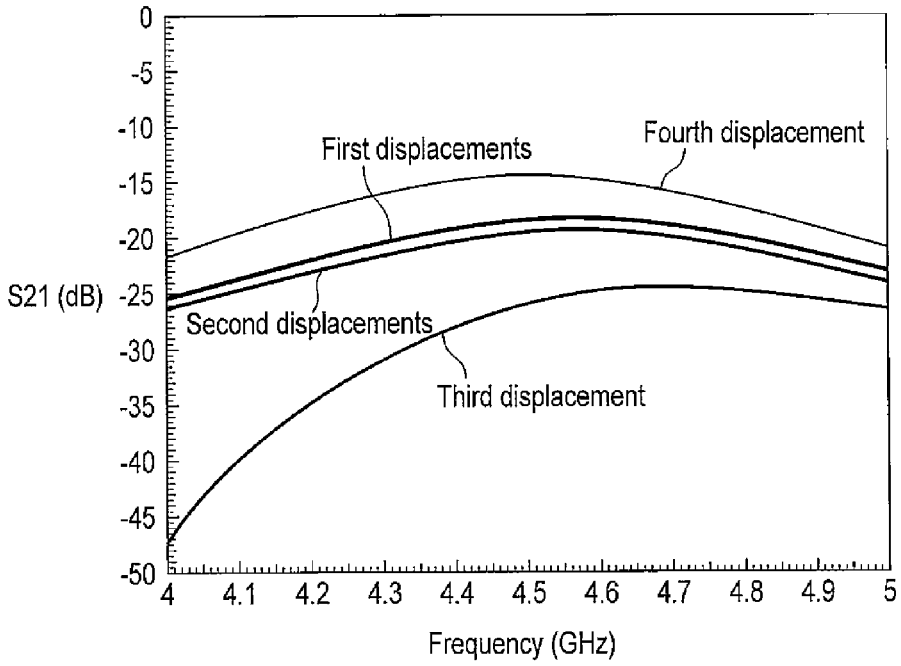
FIG. 13 is a view showing a change in S21 associated with a displacement of the coupler apparatus, which is obtained by eliminating one of the two connecting elements in the coupler apparatus depicted in FIG. 1 to FIG. 3, from the reference coupler.

One of the connecting elements 16 and 17 may be omitted, or three or more connecting elements may be provided. In this case, however, the connecting elements are placed in a biased manner based on a pattern obtained by projecting the current paths depicted in FIG. 7 onto a plane where the ground plane is present. Therefore, when the test coupler 101 is displaced in a direction orthogonal to the center axis in many ways from the state depicted in FIG. 10, a variation in S21 is small as shown in FIG. 12 if the test coupler 101 is the coupler apparatus 1, but a variation in S21 is large as shown in FIG. 13 if the test coupler 101 is a coupler apparatus constituted by omitting the connecting element 17 from the coupler apparatus 1. However, each of first to fourth displacements shown in FIG. 12 and FIG. 13 represents a state that the test coupler 101 is displaced 10 mm in each of the first to fourth directions depicted in FIG. 10 from the state shown in FIG. 10. Furthermore, although a distance between the test coupler 101 and the reference coupler 102 is 15 mm in FIG. 10, characteristic values shown in FIG. 12 and FIG. 13 are values obtained when the distance between the test coupler 101 and the reference coupler 102 in FIG. 10 is 10 mm.

Therefore, it is desirable to provide the plurality of connecting elements and dispose the connecting elements to the ground plane 14 at symmetrical positions based on the pattern obtained by projecting the paths of the currents contributing to electromagnetic coupling in the coupling element 11 onto the plane where the ground plane 14 is present.

Figure 14:
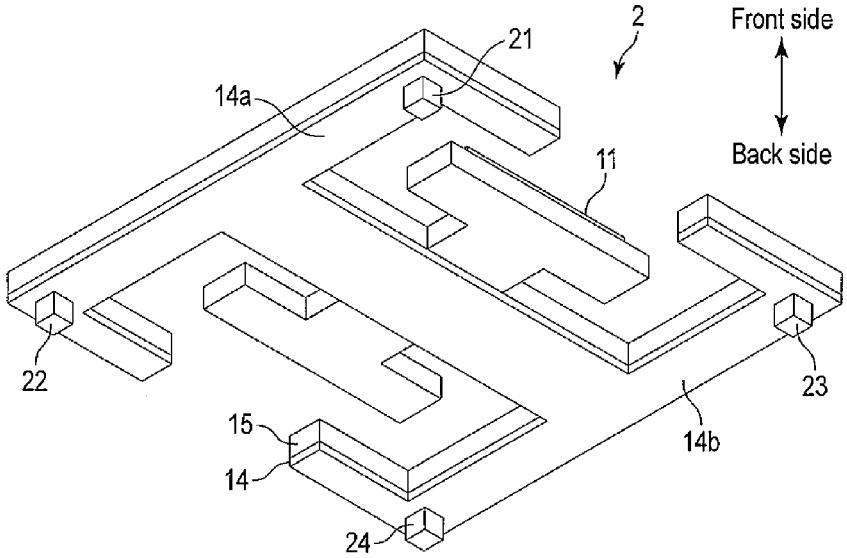
FIG. 14 is a perspective view of a coupler apparatus as a first modification.

FIG. 14 is a perspective view of a coupler apparatus 2 according to a first modification. It is to be noted that, in FIG. 14, like reference numerals denote parts equal to those in FIG. 1 to FIG. 3 in FIG. 14 and a detailed description of these parts will be omitted.

The coupler apparatus 2 comprises four connecting elements 21, 22, 23, and 24 in place of the connecting elements 16 and 17 in the coupler apparatus 1. The connecting elements 21, 22, 23, and 24 may be the same as the connecting elements 16 and 17. The connecting elements 21 and 22 are disposed at both ends of a rectangular portion 14*a*, and the connecting elements 23 and 24 are disposed at both ends of a rectangular portion 14*b*, respectively.

Figure 15:
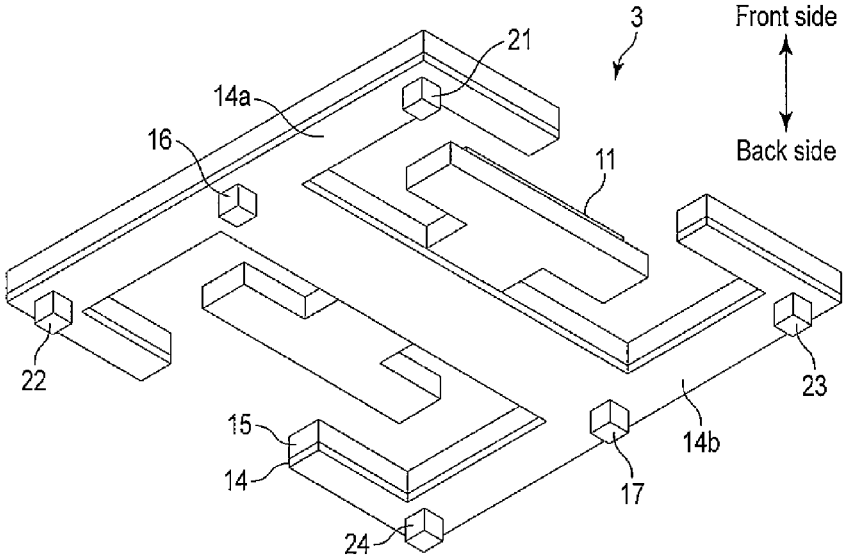
FIG. 15 is a perspective view of a coupler apparatus as a second modification.

FIG. 15 is a perspective view of a coupler apparatus 3 as a second modification. It is to be noted that, in FIG. 15, like reference numerals denote parts equal to those in FIG. 1 to FIG. 3 and FIG. 14 and a detailed description of these parts will be omitted.

The coupler apparatus 3 comprises connecting elements 21, 22, 23, and 24 in addition to the connecting elements 16 and 17 in the coupler apparatus 1.

Figure 16:
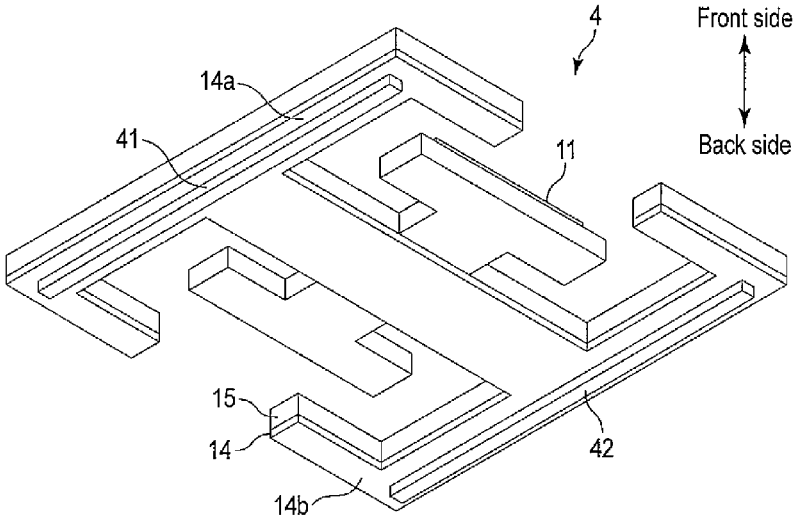
FIG. 16 is a perspective view of a coupler apparatus as a third modification.

FIG. 16 is a perspective view of a coupler apparatus 4 as a third modification. It is to be noted that, in FIG. 16, like reference numerals denote parts equal to those in FIG. 1 to FIG. 3 and a detailed description of these parts will be omitted.

The coupler apparatus 4 comprises two connecting elements 41 and 42 in place of the connecting elements 16 and 17 in the coupler apparatus 1. Each of the connecting elements 41 and 42 is a linear element. The connecting elements 41 and 42 are disposed to rectangular portions 14*a* and 14*b* in a state that the connecting elements 41 and 42 are parallel to the rectangular portions 14*a* and 14*b*, respectively. It is to be noted that a shield gasket is preferable as each of the connecting elements 41 and 42.

Figure 17:
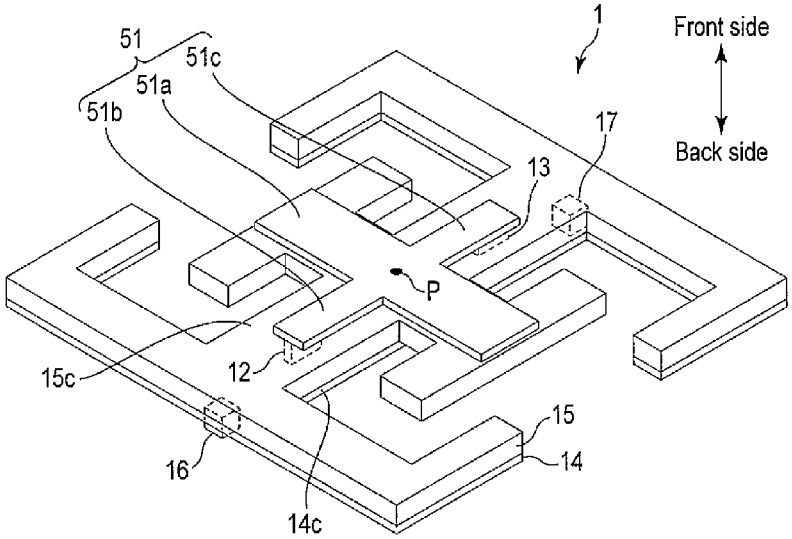
FIG. 17 is a perspective view of a coupler apparatus as a fourth modification.

FIG. 17 is a perspective view of a coupler apparatus 5 as a fourth embodiment. It is to be noted that, in FIG. 17, like reference numerals denote parts equal to those in FIG. 1 to FIG. 3 and a detailed description of these parts will be omitted.

The coupler apparatus 5 comprises a coupling element 51 in place of the coupling element 11 in the coupler apparatus 1. The coupling element 51 has a tabular shape, and its shape on a plane orthogonal to a thickness direction of this element is a shape bonding rectangular portions 51*a*, 51*b*, and 51*c*. The rectangular portion 51*a* has an elongated rectangular shape, and its longitudinal direction is substantially orthogonal to a rectangular portion 14*c* in a ground plane 14. Further, both ends of the rectangular portion 51*a* are open ends. The rectangular portions 51*b* and 51*c* have an elongated rectangular shape and protrude from the center of the rectangular portion 51*a* in opposite directions. A longitudinal direction of each of the rectangular portions 51*b* and 51*c* is substantially parallel to the rectangular portion 14*c* in the ground plane 14. Short elements 12 and 13 are in contact with the coupling element 51 in the vicinity of respective ends of the coupling elements 51*b* and 51*c*. It is to be noted that, as described in conjunction with FIG. 1 to FIG. 3, positions at which the short elements 12 and 13 are in contact with the coupling element 51 may be positions other than the ends of the coupling elements 51*b* and 51*c*. That is, the short element 12 is in contact with the coupling element 51*b* in the range from a feeding point P to the end of the coupling element 51*b*, and the short element 13 is in contact with the coupling element 51*c* in the range from the feeding point P to the end of the coupling element 51*c*.

In the fourth modification, the ground plane 14 may be substituted by another ground plane in which all or some of respective portions other than the rectangular portion 14*c* are omitted, or it may be substituted by another ground plane that is different in shapes of respective portions from the ground plane 14, e.g., a flat plate having a shape different from the rectangular portion 14*c*. Furthermore, the dielectric 15 may be substituted by another dielectric in which all or some of respective portions other than the rectangular portion 15*c* are omitted, or it may be substituted by another dielectric that is different in shapes of respective portions from the dielectric 15, e.g., a flat plate having a shape different from the rectangular portion 15*c*.

Besides, the following modifications can be implemented.

The coupling element 11 may be substituted by coupling elements having various shapes, e.g., a shape which does not have one of the rectangular portions 11*d* and 11*e* or a circular shape.

The ground plane 14 may be substituted by ground planes having various shapes, e.g., a shape in which a plane orthogonal to the thickness direction is a simple rectangular shape or a shape bonding the rectangular portion 14*d* to the rectangular portion 14*f* or bonding the rectangular portion 14*e* to the rectangular portion 14*g*.

The dielectric 15 does not have to be provided.

It is to be noted that a configuration shown in each drawing represents an outline of shapes or positional relationships of respective elements, and dimension ratios of some of the elements do not have to be faithful to the drawings. For example, the coupling element 11 may have a larger thickness than the ground plane 14 in some cases. Furthermore, when the dielectric 15 has a thickness depicted in FIG. 1, the thickness of the ground plane 14 may be smaller than that shown in FIG. 1 in some cases.

The various modules of the systems described herein can be implemented as software applications, hardware and/or software modules, or components on one or more computers, such as servers. While the various modules are illustrated separately, they may share some or all of the same underlying logic or code.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A coupler in a housing of an electronic apparatus, the coupler being arranged to be adjacent to a device in the housing, the device comprising a metal member, the coupler configured to transmit to or receive from another coupler electromagnetic waves by electromagnetic coupling, the coupler comprising:

a coupling element made of a first tabular electrical conducting material, wherein power feeding is performed from a feeding cable to a reference point;

a ground plane made of a second tabular electrical conducting material, comprising a first surface and a second surface opposed to the first surface, the first surface facing coupling element;

at least one short element configured to short the coupling element and the ground plane; and at least one connecting element made of an electrical conducting material, disposed to the second surface of the ground plane, contacting the metal member, and electrically connecting the second surface of the ground plane to the metal member, wherein the metal member is made of a tabular electrical conducting material, and the ground plane and the metal member extend parallel to each other.

2. The coupler of claim 1, further comprising a dielectric arranged between the coupling element and the ground plane.

3. The coupler of claim 1, wherein the at least one short element comprises first and second short elements which short the coupling element and the ground plane at different positions, and the at least one connecting element comprises first and second connecting elements aligned in a substantially the same direction as an alignment direction of the first and second short elements.

4. The coupler of claim 3, wherein the coupling element comprises a tabular conductive portion having an elongated rectangular shape on a plane orthogonal to a thickness direction thereof, and a longitudinal direction of the conductive portion substantially coincides with the alignment direction of the first and second short elements, and the first short element is in contact with the coupling element between one end of the conductive portion in the longitudinal direction and the reference point, and the second short element is in contact with the coupling element between other end of the conductive portion and the reference point.

5. The coupler of claim 1, wherein the coupling element comprises a tabular first conductive portion having an elongated rectangular shape in a plane orthogonal to a thickness direction thereof and a second conductive portion having an open end, and the at least one short element comprises first and second short elements aligned along a longitudinal direction of the first conducive portion and configured to short the first conductive portion and the ground plane at different positions.

6. The coupler of claim 1, wherein the coupling element comprises a tabular shape having first, second, third, and fourth open ends;

four current paths, where a length from the reference point to each of the first, second, third, and the fourth open ends comprises a length substantially corresponding to an integral multiple of ¼ of a wavelength of a central frequency of an electromagnetic wave;

at least two of the four current paths are partially parallel to a first direction and opposite to each other; and at least two of the four current paths are partially parallel to a second direction substantially orthogonal to the first direction and opposite to each other.

7. An electronic apparatus comprising:

a housing;

a device in the housing, the device comprising a metal member; and a coupler in the housing, the coupler being arranged to be adjacent to the device, the coupler configured to transmit to or receive from another coupler electromagnetic waves by electromagnetic coupling, the coupler comprising:

a coupling element made of a first tabular electrical conducting material, wherein power feeding is performed from a feeding cable to a reference point;

a ground plane made of a second tabular electrical conducting material, comprising a first surface and a second surface opposed to the first surface, the first surface facing the coupling element at least one short element configured to short the coupling element and the ground plane; and at least one connecting element made of an electrical conducting material, disposed to the second surface of the ground plane, contacting the metal member, and electrically connecting the second surface of the ground plane with the metal member, wherein the metal member is made of a tabular electrical conducting material, and the ground plane and the metal member extend parallel to each other.

8. The apparatus of claim 7, further comprising a dielectric arranged between the coupling element and the ground plane.

9. The apparatus of claim 7, wherein the at least one short element comprises first and second short elements which short the coupling element and the ground plane at different positions, and the at least one connecting element comprises first and second connecting elements aligned in a substantially the same direction as an alignment direction of the first and second short elements.

10. The apparatus of claim 9, wherein the coupling element comprises a tabular conductive portion having an elongated rectangular shape on a plane orthogonal to a thickness direction thereof, and a longitudinal direction of the conductive portion substantially coincides with the alignment direction of the first and second short elements, and the first short element is in contact with the coupling element between one end of the conductive portion in the longitudinal direction and the reference point, and the second short element is in contact with the coupling element between other end of the conductive portion and the reference point.

11. The apparatus of claim 7, wherein the coupling element comprises a tabular first conductive portion having an elongated rectangular shape in a plane orthogonal to a thickness direction thereof and a second conductive portion having an open end, and the at least one short element comprises first and second short elements aligned along a longitudinal direction of the first conducive portion and configured to short the first conductive portion and the ground plane at different positions.

12. The apparatus of claim 7, wherein the coupling element comprises a tabular shape having first, second, third, and fourth open ends;

four current paths, where a length from the reference point to each of the first, second, third, and the fourth open ends comprises a length substantially corresponding to an integral multiple of ¼ of a wavelength of a central frequency of an electromagnetic wave;

at least two of the four current paths are partially parallel to a first direction and opposite to each other; and at least two of the four current paths are partially parallel to a second direction substantially orthogonal to the first direction and opposite to each other.

13. The coupler of claim 1, wherein the ground plane comprises first and second elongated conductive portions parallel to each other and a third elongated conductive portion connecting between intermediate parts of the first and second elongated conductive portions, the coupling element comprises an elongated conductive portion facing the third elongated conductive portion, wherein a longitudinal direction of the elongated conductive portion of the coupling element is shorter than a longitudinal direction of the third elongated conductive portion, and the at least one connecting element comprises first and second connecting elements respectively placed at the intermediate parts.

14. The apparatus of claim 7, wherein the ground plane comprises first and second elongated conductive portions parallel to each other and a third elongated conductive portion connecting between intermediate parts of the first and second elongated conductive portions, the coupling element comprises an elongated conductive portion facing the third elongated conductive portion, wherein a longitudinal direction of the elongated conductive portion of the coupling element is shorter than a longitudinal direction of the third elongated conductive portion, and the at least one connecting element comprises first and second connecting elements respectively placed at the intermediate parts.

* * * * *